US012677886B1

(12) United States Patent
Schmiechen

(10) Patent No.: US 12,677,886 B1
(45) Date of Patent: Jul. 14, 2026

(54) POCKET-SQUARE-HOLDING DEVICE

(71) Applicant: Theodore H. Schmiechen, Philadelphia, PA (US)

(72) Inventor: Theodore H. Schmiechen, Philadelphia, PA (US)

( * ) Notice: Subject to any disclaimer, the term of this patent is extended or adjusted under 35 U.S.C. 154(b) by 0 days.

(21) Appl. No.: 19/357,896

(22) Filed: Oct. 14, 2025

(51) Int. Cl.
*A41B 15/00* (2006.01)
*A41B 15/02* (2006.01)

(52) U.S. Cl.
CPC ..... *A41B 15/02* (2013.01)

(58) Field of Classification Search
CPC ..... A41B 15/02
See application file for complete search history.

(56) References Cited

U.S. PATENT DOCUMENTS 2,022,793 A * 12/1935 Trickel ..... A45F 5/04 318/276
2,136,691 A * 11/1938 Jasperson ..... A41B 15/02 2/279
2,211,023 A * 8/1940 Murphy ..... A41B 15/02 24/336
2,597,146 A * 5/1952 Ginal, Jr. ..... A41B 15/02 206/37
2,716,755 A * 9/1955 Foglio ..... A41B 15/02 2/300
2,722,013 A * 11/1955 Fisher ..... A41B 15/02 2/279
2,778,080 A * 1/1957 Kernicki ..... A41B 15/02 2/279
4,417,370 A * 11/1983 Lewis ..... A41B 15/02 24/3.11
7,168,137 B1 * 1/2007 Oustian ..... A41B 15/02 24/7
9,051,681 B1 * 6/2015 Costa ..... D06F 89/02
2014/0352034 A1 * 12/2014 Bhiro ..... A41B 15/02 2/279
2015/0096110 A1 * 4/2015 Guvenc ..... A41B 15/02 2/279
2015/0157059 A1 * 6/2015 Muratore ..... A41B 15/02 2/279
2016/0015086 A1 * 1/2016 Kinnebrew ..... A44B 99/00 428/220
2016/0120234 A1 * 5/2016 Cobb ..... A41B 15/02 2/250
2016/0157526 A1 * 6/2016 Adeniji ..... A41B 15/02 2/279
2017/0231290 A1 * 8/2017 Jensen ..... A41D 27/20 2/249
2020/0093191 A1 * 3/2020 Jones ..... A41B 15/02
2021/0212388 A1 * 7/2021 Kim ..... A41B 15/02
2025/0089817 A1 * 3/2025 Nelkin ..... A41B 15/02

* cited by examiner

*Primary Examiner* — Robert H Muromoto, Jr.
(74) *Attorney, Agent, or Firm* — Keeley DeAngelo LLP; W Scott Keeley

(57) ABSTRACT

An adjusting pocket-square-holding device holds a pocket square flat and secured in a clothing pocket as desired by the wearer for the duration of wear. The pocket-square-holding device's adjusting feature enables fitting in pockets of various sizes and depths, in varying configurations. The device has a top section, a lower section, and an adjustable, looped, linear spring that joins the two. The linear spring's wavy shape enables adjustments in the device's height so that the pocket square can be held at varying heights in the pocket. Under tension, the linear spring may be slid up or down to adjust the device's height.

6 Claims, 3 Drawing Sheets

POCKET-SQUARE-HOLDING DEVICE

TECHNICAL FIELD OF THE INVENTION

The present invention relates generally to the field of wearing apparel, and more specifically to devices that work with breast-pocket handkerchiefs.

BACKGROUND OF THE INVENTION

Pocket squares are decorative handkerchiefs or cloths that are folded into a garment's breast pocket, with their top section intended to be displayed above the pocket. As decorative elements, they are often folded artistically and displayed emerging from the breast pocket of a man's jacket. Various devices are used to hold these fabric squares in place, but they often fail to hold the fabric upright and with the intended folds intact. Some devices are cards or armatures in which one may weave a pocket square to hold it in place in the breast pocket, but these can be bulky and complicated to use, and they tend to slide about in a pocket, causing the pocket square to lose its neatly folded shape. Devices in the art also lack height adjustment. An improved device would be held by some tension in the pocket and allow easy adjustment for accommodating varying styles of pocket-square folds and pocket depths.

SUMMARY OF THE INVENTION

An adjusting pocket-square-holding device holds a pocket square flat and tightly secured in a clothing pocket as desired by the wearer for the duration of wear. The pocket-square-holding device's adjusting feature enables fitting in pockets of various sizes or depths, in varying configurations.

In a preferred embodiment, the adjusting pocket-square-holding device has three sections formed preferably in metal wire: a top section, a lower section, and an adjustable, looped, linear spring that joins the two. The lower section is triangular, with its base designed to rest along the bottom of a pocket. The top section is also triangular, with a crossbar clasp at one end for holding the pocket square. The looped linear spring connects the upper and lower sections. The linear spring's wavy shape enables adjustments in the device's height so that the pocket square can be held at varying heights in the pocket. Under tension, the linear spring may be slid up or down to adjust the device's height.

By use of a clasping mechanism in the device's top section, a pocket square can be held in the top section, while the bottom section serves as a support inside a garment pocket. A user compresses a central linear spring and slides it to a desired position to fix the device's height, then allows the linear spring to expand in place. This mechanism adjusts the height of the device so that a pocket square may sit high or low, as desired, in a pocket. The clasp holds the pocket square flat in its folded position in a pocket, preventing lumps and movement in the pocket.

DETAILED DESCRIPTION OF THE INVENTION

Figure 1:
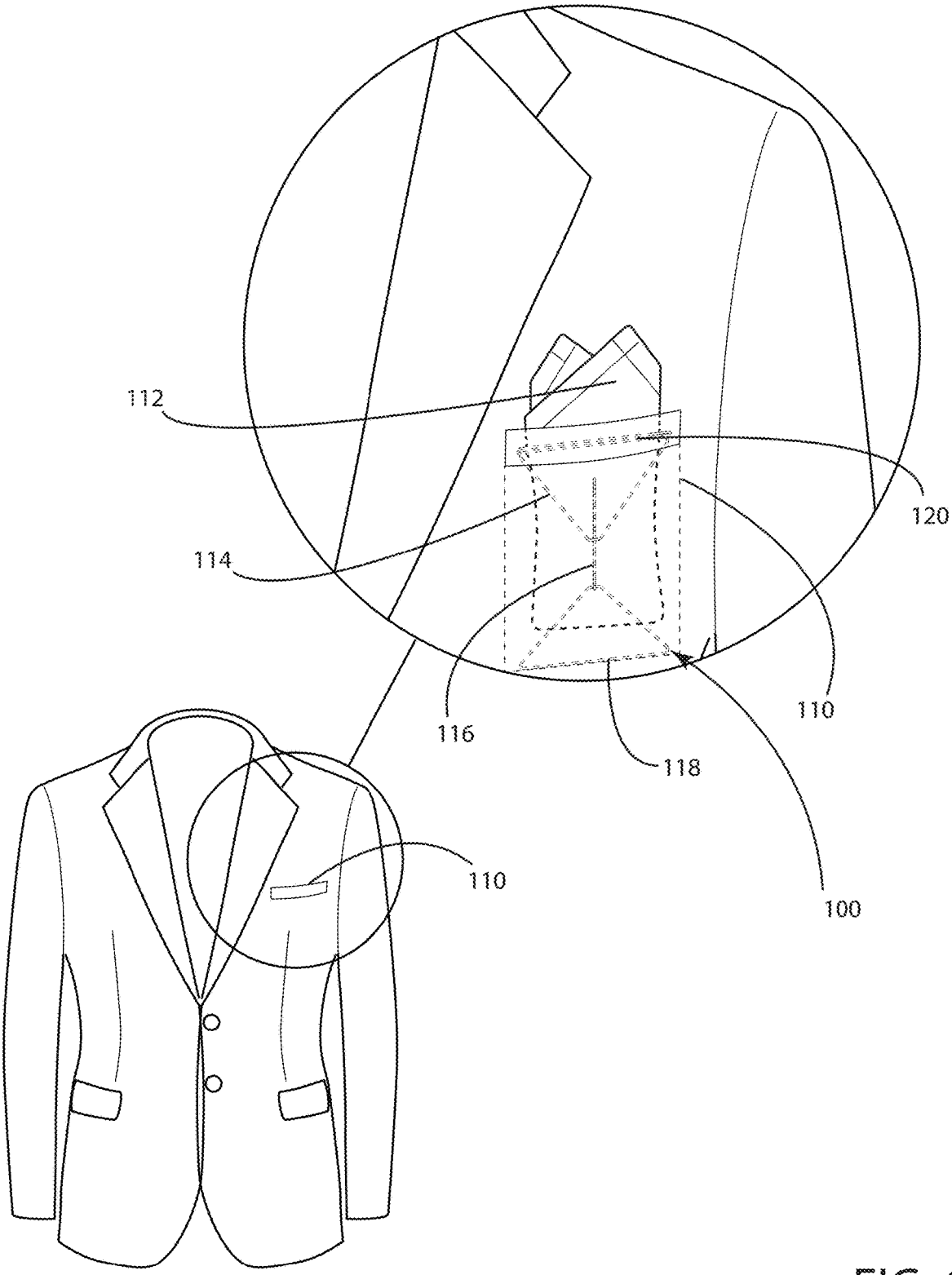
FIG. 1 is a perspective view of an adjusting pocket-square-holding device.

FIG. 1 shows the device 100 holding a pocket square 112 at a particular depth in a pocket 110. The device 100 enables adjusting the pocket square 112 to a desired depth and location in a garment pocket 110.

A preferred embodiment of the device has at least four sections: a substantially triangular, top section 114 with a clasping arm (FIG. 3); a substantially triangular lower section 118; and an adjusting, looped, linear spring 116 that joins the two triangular sections. The lower section is triangular, with its base designed to rest along the bottom of a pocket. The top section has a crossbar clasp at one end for holding the pocket square between the clasp arm (FIG. 3) and the top section.

The linear spring's wavy shape enables compression-fit adjustments in the device's height so that the pocket square can be held at varying heights in the pocket. Under tension, the linear spring may be slid up or down to adjust the device's height. The crests 122 and troughs 128 of the linear spring's waves compress and expand as the linear spring is slid up or down, to land where desired in the top section's lower ring 124. Attached to the device's top section 114 is a long arm that serves as a clasp 120 for holding an inserted pocket square. The clasp 120 is laterally oriented along the top section 114 to allow as much room as possible for the pocket square to be inserted and secured there.

Figure 2:
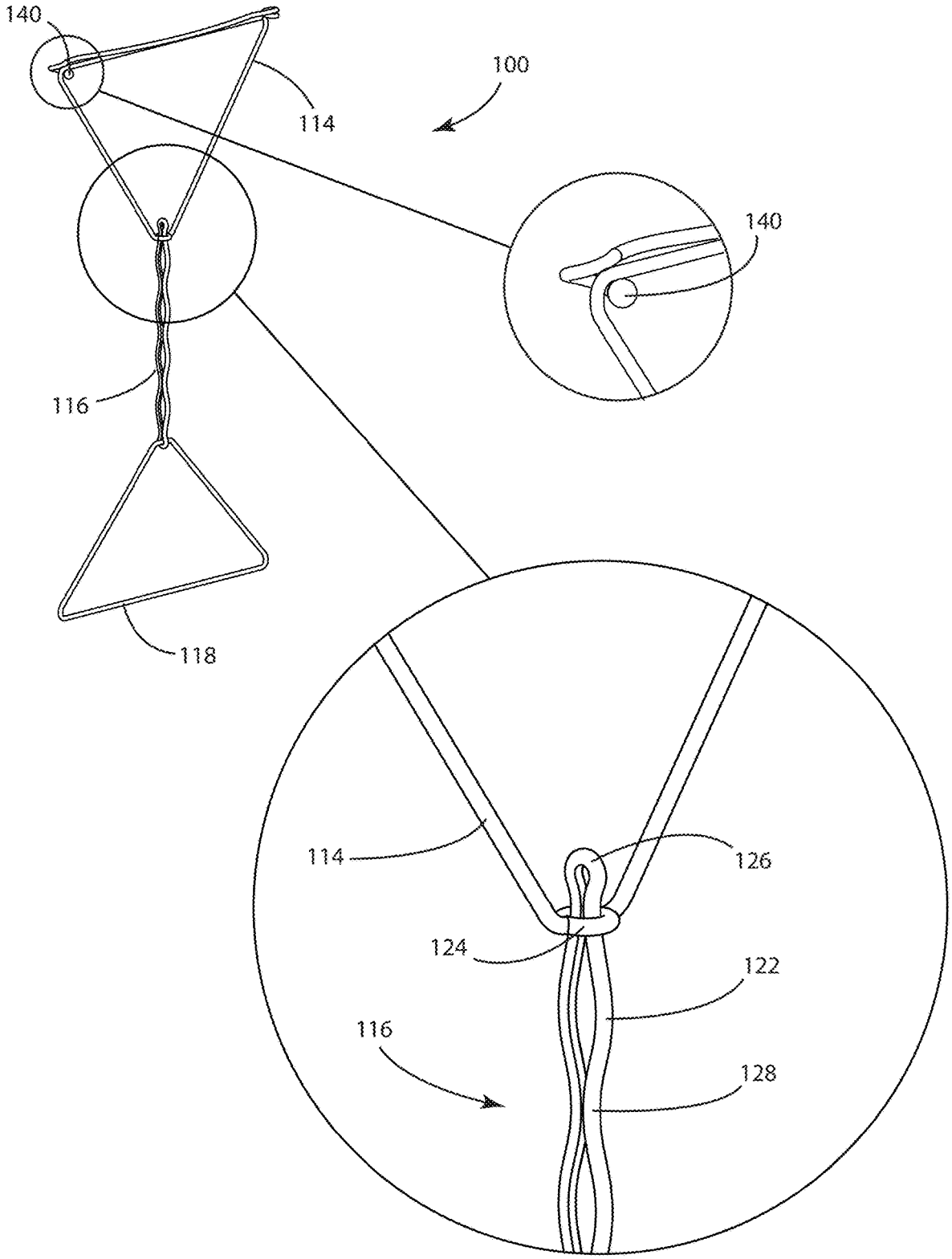
FIG. 2 is a perspective view thereof a looped linear spring 116 of the pocket-square-holding device.

FIG. 2 shows the adjusting mechanism of the device. A looped, linear spring 116 connects the top section 114 to the lower section 118. The linear spring's 116 upper loop 126 rests inside the top section's 114 lower ring 124. The upper loop 126 of the linear spring 116 prevents the linear spring from fitting through the lower ring 124 and thus from detaching from the top section 114. The linear spring 116 loops around the narrow end of the lower section 118 and is affixed thereto. The linear spring 116 is a wavy length of metal that, when under tension, compresses to fit through the top section's 114 lower ring 124. To adjust the device's height, a user compresses the linear spring and slides it to a desired position, then allows the linear spring to expand in place in the lower ring 124 of the top section 114. Once expanded, the linear spring tensions against the top section's lower ring 124, as a trough 128 resides in the lower ring 124, to hold the device in this adjusted position. This mechanism adjusts the height of the device, so that a pocket square may sit high or low, as desired, in a pocket.

Figure 3:
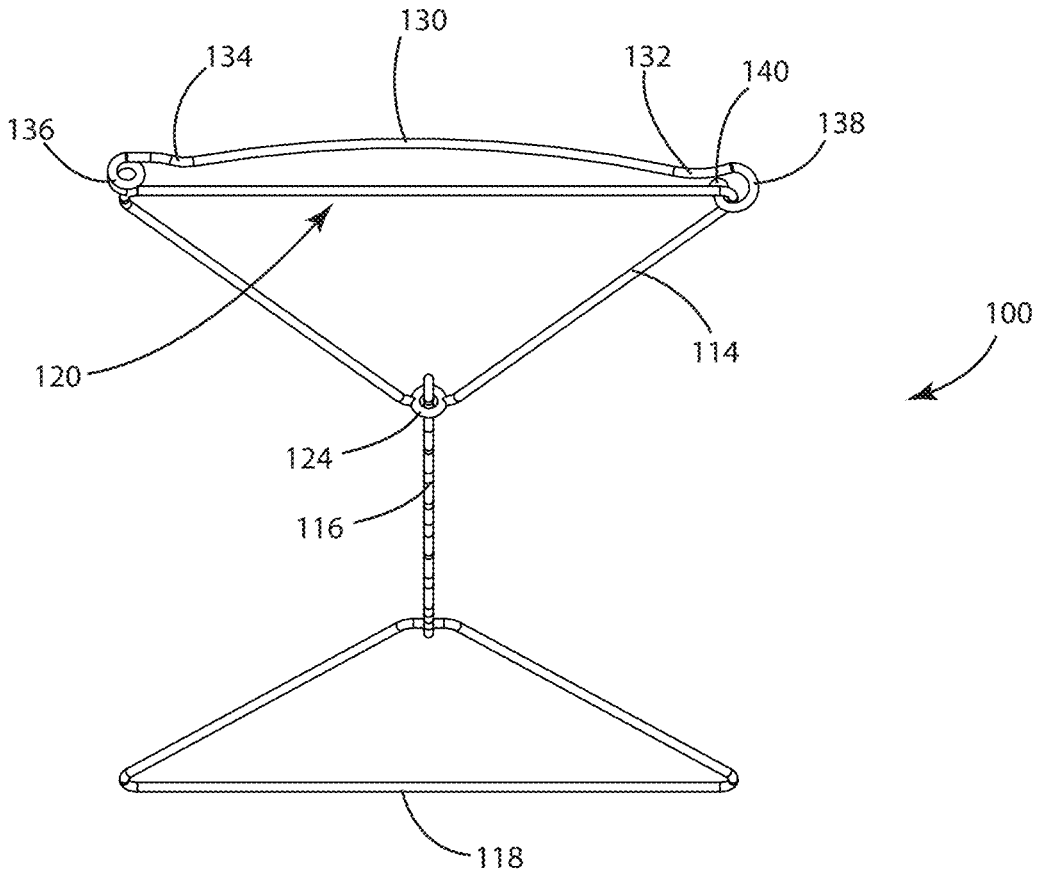
FIG. 3 is an exploded view of a top section 114 of the adjusting pocket-square-holding device, specifically how a clasp 120 and a cross bar 130 hold a pocket square 112 to the top section 114 of the device.

FIG. 3 shows the device's clasping mechanism, which holds a pocket square 112 (FIG. 1) in a pocket 110 (FIG. 1). A long-armed clasp 130 is a curved piece of metal which holds the pocket square to the top part of the top section 114. The curving clasp 130 has a space for a pocket square 112 (FIG. 1) to be inserted between the top section 114 and the clasp bar, and secured with the clasp. A spring coil 136 on one end of the cross bar 130 connects the curving clasp 130 to the uppermost arm 120 of the top section 114. The two curves in the clasp are defined by a first inward curve 134 and a second inward curve 132 which together serve to provide a space between the cross bar 130 and the clasp 120, into which the pocket square is secured. The clasp's securing curve prevents lumps from forming in the pocket where the device is inserted.

A hook 138 on the other side of the clasp connects the clasp end to the uppermost arm 120 of the top section 114. The hook has on its end an interfering ball 140 that prevents the clasp from releasing.

A user releases the clasp by disengaging the interfering ball 140 and hook 138, and releases the clasp to allow a pocket square to be inserted, adjusted or removed from the top section 114.

The invention claimed is:

1. An adjustable device for holding a pocket square comprising:

a top section configured to secure a pocket square, further comprising a lower ring; and a lower section configured to rest within a garment pocket; and an adjustable wavy linear spring having an array of waves and troughs, connecting said top section and said lower section; wherein said wavy linear spring passes through the lower ring of said top section as each wave compresses to pass through; and wherein a height of the device is adjusted by sliding said linear spring to a selected position within said lower ring; and wherein a trough of the wavy linear spring engages with said lower ring to set the height of the device.

2. The device of claim 1 wherein:

said top section and said lower section are triangular in shape.

3. The device of claim 1 wherein:

said top section further comprises a clasping arm pivotally attached thereto for securing the pocket square against said top section.

4. The device of claim 3 wherein:

said clasping arm is secured in a closed position by a hook, said hook further comprising an interfering ball that prevents unintentional release of the clasping arm.

5. The device of claim 3 wherein:

said clasping arm is attached to said top section by way of a spring coil; and said spring coil is configured to apply tension to the clasping arm when in a closed position.

6. The device of claim 1 wherein:

said linear spring comprises an upper loop having a dimension that is greater than an opening in said lower ring, thereby preventing detachment of said linear spring from said top section.

* * * * *